US007454146B2

(12) United States Patent
Bischel et al.

(10) Patent No.: US 7,454,146 B2
(45) Date of Patent: Nov. 18, 2008

(54) FUSER ASSEMBLY INCLUDING MEMORY

(75) Inventors: Patrick O. Bischel, Paris, KY (US); Kevin Dean Schoedinger, Lexington, KY (US); David Randall Word, Lexington, KY (US); Andrew Michael Zopff, Lawrenceburg, KY (US)

(73) Assignee: Lexmark International, Inc., Lexington, KY (US)

( * ) Notice: Subject to any disclaimer, the term of this patent is extended or adjusted under 35 U.S.C. 154(b) by 136 days.

(21) Appl. No.: 11/073,824

(22) Filed: Mar. 7, 2005

(65) Prior Publication Data

US 2006/0198642 A1 Sep. 7, 2006

(51) Int. Cl.
*G03G 15/00* (2006.01)
*G03G 15/20* (2006.01)

(52) U.S. Cl. ..... 399/12; 399/33; 399/43; 399/45

(58) Field of Classification Search ..... 399/33, 399/43, 45, 67, 12, 122, 87
See application file for complete search history.

(56) References Cited

U.S. PATENT DOCUMENTS 4,774,544 A 9/1988 Tsuchiya et al.
4,961,088 A * 10/1990 Gilliland et al. ..... 399/12
5,016,171 A 5/1991 Connolly et al.
5,021,828 A 6/1991 Yamaguchi et al.
5,066,978 A 11/1991 Watarai et al.
5,101,233 A 3/1992 Ito et al.
5,129,050 A * 7/1992 Ikenoue et al.
5,237,522 A * 8/1993 Iwai
5,436,709 A * 7/1995 Sakaizawa et al.
5,489,971 A 2/1996 Nam
5,568,229 A * 10/1996 Szlucha ..... 399/43
5,673,106 A 9/1997 Thompson
5,682,140 A 10/1997 Christensen et al. ..... 340/540
6,016,409 A * 1/2000 Beard et al. ..... 399/33
6,389,241 B1 * 5/2002 Cernusak et al. ..... 399/45
6,643,477 B2 * 11/2003 Mitsuoka et al.
7,190,911 B2 * 3/2007 Sato et al. ..... 399/12
2003/0118353 A1 * 6/2003 Baller et al.
2003/0219276 A1 * 11/2003 Sato et al.
2004/0028420 A1 * 2/2004 Aslam et al. ..... 399/45
2004/0207865 A1 * 10/2004 Wachter et al.

FOREIGN PATENT DOCUMENTS

JP 03261984 A * 11/1991
JP 10210212 A * 8/1998
JP 11151845 A * 6/1999
JP 2002169408 A * 6/2002
JP 2002341705 A * 11/2002
JP 2003005589 A * 1/2003

* cited by examiner

*Primary Examiner*—Susan S Lee

(57) ABSTRACT

A fuser assembly is provided with an onboard memory that may be used to store information useful in determining the conditions under which the fuser assembly has been operated. Such information can be used to better understand the root cause of fuser assembly failures, and estimate remaining fuser life, etc.

26 Claims, 3 Drawing Sheets

FUSER ASSEMBLY INCLUDING MEMORY

TECHNICAL FIELD

This disclosure relates generally to image forming systems, e.g. printers and copiers, and more particularly to fuser assemblies used in image forming systems.

BACKGROUND

Laser printers and other, similar image forming systems form images on paper or other media using electrostatically charged toner particles, which usually include pigment and plastic. Paper with a temporary toner image is fed through a fuser, which melts the plastic in the toner, and pushes the melted plastic and pigment into the paper to form a permanent image.

Fuser assemblies in many printers tend to require relatively frequent replacement compared to some other printer components. Determining why a particular fuser requires replacement can be difficult, however, because most conventional printers do not provide a way to determine the conditions under which a failed fuser assembly was used.

SUMMARY

An embodiment of the present disclosure provides a fuser assembly for an image forming apparatus. The fuser assembly may include heating and pressure members that may cooperate to affix, e.g., fuse, an image onto a medium passing through a nip formed between the two members. The fuser may also include a memory to store information associated with the fuser assembly and information not associated with the fuser assembly.

Another embodiment of the present disclosure provides an image forming system, which may include a sensor to monitor system operation, a print engine to deposit toner on a medium to form an image, and an assembly to affix, e.g., fuse the image to the medium. The fuser assembly may include an on-board memory capable of storing information associated with the sensor.

Yet another embodiment of the present disclosure provides a method for use in an image forming system including a fuser assembly. The method may include monitoring at least one usage parameter associated with the fuser assembly, and storing at least one usage parameter to a memory included in the fuser assembly.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Embodiments of the present invention are best understood by reference to FIGS. 1 through 4, wherein like numbers are used to indicate like and corresponding parts.

Figure 1:
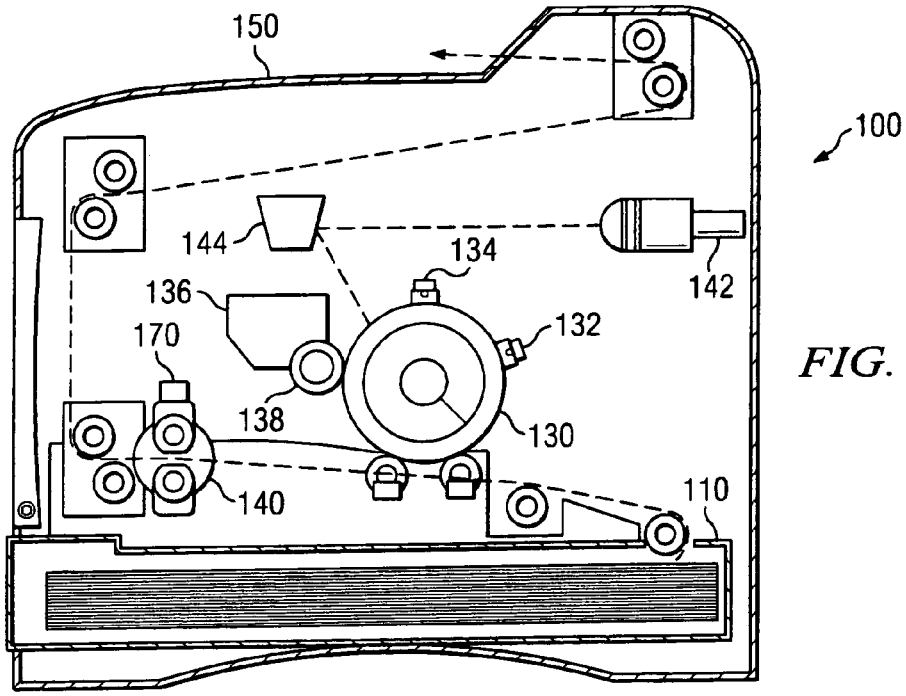
FIG. 1 is a diagram illustrating a cross section of a laser printer according to an embodiment of the present disclosure.

Referring first to FIG. 1, an image forming apparatus 100 will be discussed according to an embodiment of the present disclosure. System 100 illustrates a laser printer in which a page of paper or other media (not illustrated) from paper tray 110 is moved along path 120 and past photoreceptor drum assembly 130, where a toner image is deposited onto the page. The page moves through fuser 140, where the toner image is fused onto the page, and into output tray 150.

A processor (not illustrated) may control laser scanning unit 142 to produce a beam of light, which may be reflected from mirror 144 and onto photoreceptor drum assembly 130, which may carry an electrostatic charge generated by a charge roll 134. Light impacting photoreceptor drum assembly 130 may discharge portions of photoreceptor drum assembly 130, resulting in the discharged portions having a net negative charge compared to the rest of photoreceptor drum assembly 130. As photoreceptor drum assembly 130 rotates past developer roller 138, toner on developer roller 138 may cling to the discharged portions of photoreceptor drum assembly 130.

Photoreceptor drum assembly 130 continues to rotate until the toner on the drum comes in contact with the page. The toner is deposited on top of the page to form a temporary toner image, which will become permanent when fused to the page in fuser 140. As photoreceptor drum assembly 130 continues to rotate, the cleaning blade 132 may remove any residual toner on photoreceptor drum assembly 130. A charge roll 134 may re-apply an electrostatic charge on the surface of photoreceptor drum assembly 130 in preparation for receiving the next image. Toner hopper 136 may hold toner to be delivered to photoreceptor drum assembly 130 by developer roller 138.

Fuser 140, which may be used to fuse the toner image onto the page, may include memory 170. Memory 170 may be, for example, a non-volatile memory such as a rewritable memory, or an electrically erasable programmable read-only memory (EEPROM) or the like. Memory 170 may be connected to a processor (not shown) that receives information from various sensors (not shown) indicating usage of fuser 140. For example, various types of page sensors may be placed along path 120 to indicate the position of a page as it moves through laser printer 100. Such sensors may be included in some embodiments to detect paper jams, paper widths, etc. in various portions of the unit.

Other sensors may be used to detect rotation of any of the various rollers included in the fuser 140, rotation of photoreceptor drum assembly 130, rotation of developer roller 138, or the like. Additional sensors may also be included in laser printer 100 to detect paper thickness, paper size and type, or other parameters that may affect the operation of fuser 140.

Memory 170 may be used to store setup information affecting fuser 140. So, for example, if a printer in which fuser 140 is installed is used to process paper labels, vinyl labels, envelopes, A4-type paper, perform edge-to-edge printing of photographs, or the like, memory 170 may store this and similar information. Memory 170 mg stored the number of pages per media type from when the fuser 140 is installed and store the number of pages per media type previously processed. by the printer prior to fuser 140 installation. In at least one embodiment, information stored in memory 170 allows the operational life of fuser 140 to be estimated, and may aid in diagnosing a fuser failure. Other information that may be stored in memory 170 includes, but is not limited to, identification information, e.g., a serial number associated with laser printer 100, the date on which fuser 140 was installed in laser printer 100, a number of thumps performed by the fuser 140, a number of wide media or pages processed by the fuser 140, a number of sides processed by the fuser 140, a number of narrow images processed by the fuser 140, a number of envelopes processed by fuser 140, a number of non-envelopes processed by the fuser 140, a number of card stock processed by the fuser 140, a number of revolutions associated with the fuser 140, a number of paper labels processed by the fuser 140, a number of vinyl labels processed by the fuser 140, a number of transparencies processed by the fuser 140, any continuations of the above information, or any other information that may be relevant to the operation of fuser 140.

Information not relevant to the operation of fuser 140 may also be stored in memory 170. For example, but not limited to, memory 170 may store information relating to the serial numbers of printers the fuser 140 has been installed into, e.g., a previous printer and a current printer serial number. In addition, the total number of cartridges and type of cartridges that have been used since the fuser 140 has been installed may be stored in memory 170, i.e., return, non-return, remanufactured, etc.

In addition, and according to one embodiment of the invention, memory 170 may store fuser 140 history, e.g., but not limited to events and/or error logo, installation data of fuser 140, revolutions of fuser 140, a unique string that is output when and if fuser 140 has been properly installed and/or programmed, or standby hours, and a flag to indicate fuser 140 has been installed properly and is properly programmed.

It should be appreciated that laser printer 100, is a simplified example of an embodiment of the present disclosure, and other similar embodiments may be implemented by those skilled in the art without undue experimentation. For example, a single toner hopper 136 is illustrated in laser printer 100. In other embodiments, particularly in embodiments involving color laser printers or copiers, more than one toner hopper may be used. In such embodiments, a separate toner hopper, or a partitioned toner hopper, may be employed. Additionally, laser scanning unit 142 and/or mirror 144 may move relative to one another, or relative to photoreceptor drum assembly 130, thereby facilitating formation of a charge image on photoreceptor drum assembly 130.

It should also be appreciated that while a laser printer processing a single page of paper is discussed herein, various embodiments of the present disclosure apply equally well to various copiers or other printers, including color copiers and color laser printers, which may be used to process various different media types. Various embodiments of the present disclosure may be used to form images on paper, envelopes, various types of films, including materials used for presentations using overhead projectors, photographic slides, photographic paper, cloth, or any other suitable type of media.

Figure 2:
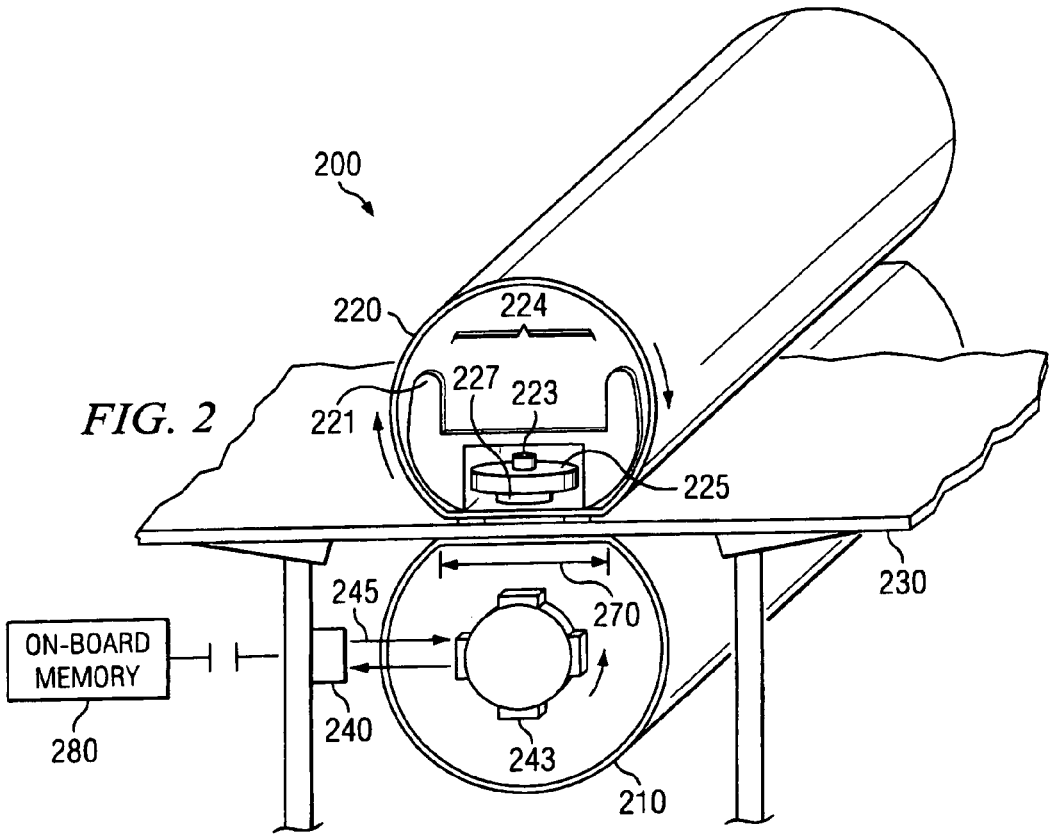
FIG. 2 is a diagram representing a perspective view of a portion of a fuser assembly according to an embodiment of the present disclosure.

Referring next to FIG. 2, a fuser assembly according to an embodiment of the present disclosure is discussed, and is designated generally fuser 200. Fuser 200 may include a heating member, such as upper belt 220, and a pressure member, such as roller 210. In some embodiments, a roller may be substituted for belt 220.

Belt 220 and roller 210 may form a nip 270, through which paper 230 is passed. Recall from the discussion of FIG. 1, that prior to entering fuser 200, a temporary toner image is deposited on the surface of paper 230. As paper 230 is pulled into nip 270, a heater 224, which may include a heating element 227, an insulating base member 225, and a temperature sensor 223, may be used to fuse the temporary toner image on paper 230 into a permanent image. Heater 224 may be held in place by a holder 221, which may be used to keep the heating element 227 positioned next to paper 230. Although not illustrated, a thin layer of insulation, e.g., glass, may be used to cover heating element 227.

Temperature sensor 223 may be coupled to a processor (not illustrated), and to onboard memory 280 in at least one embodiment of the present disclosure. In some embodiments, temperature sensor 223 may provide a temperature reading to the processor, or an intermediate comparator so that the number of temperature excursions beyond a threshold level may be counted. A predetermined number of temperature excursions may be detected, and if so onboard memory 280 may be updated.

In one embodiment, sensor 240 may be an optical sensor that provides visible light, infrared light, or another frequency of light 245 to a cooperating sensor reflector including reflective portions 243. Each time light is reflected from reflective portions 243 back to optical sensor 240, sensor 240 may produce an electrical pulse. It should be appreciated that numerous types of sensors, including other optical sensors and various mechanical-type sensors may be used to provide rotation information for roller 210. Furthermore, various sensors may also be provided for belt 220. Furthermore, in at least some embodiments, sensor 240 may not be used, but similar information may be provided to onboard memory 280 from other sensors in fuser assembly 200, or elsewhere.

Figure 3:
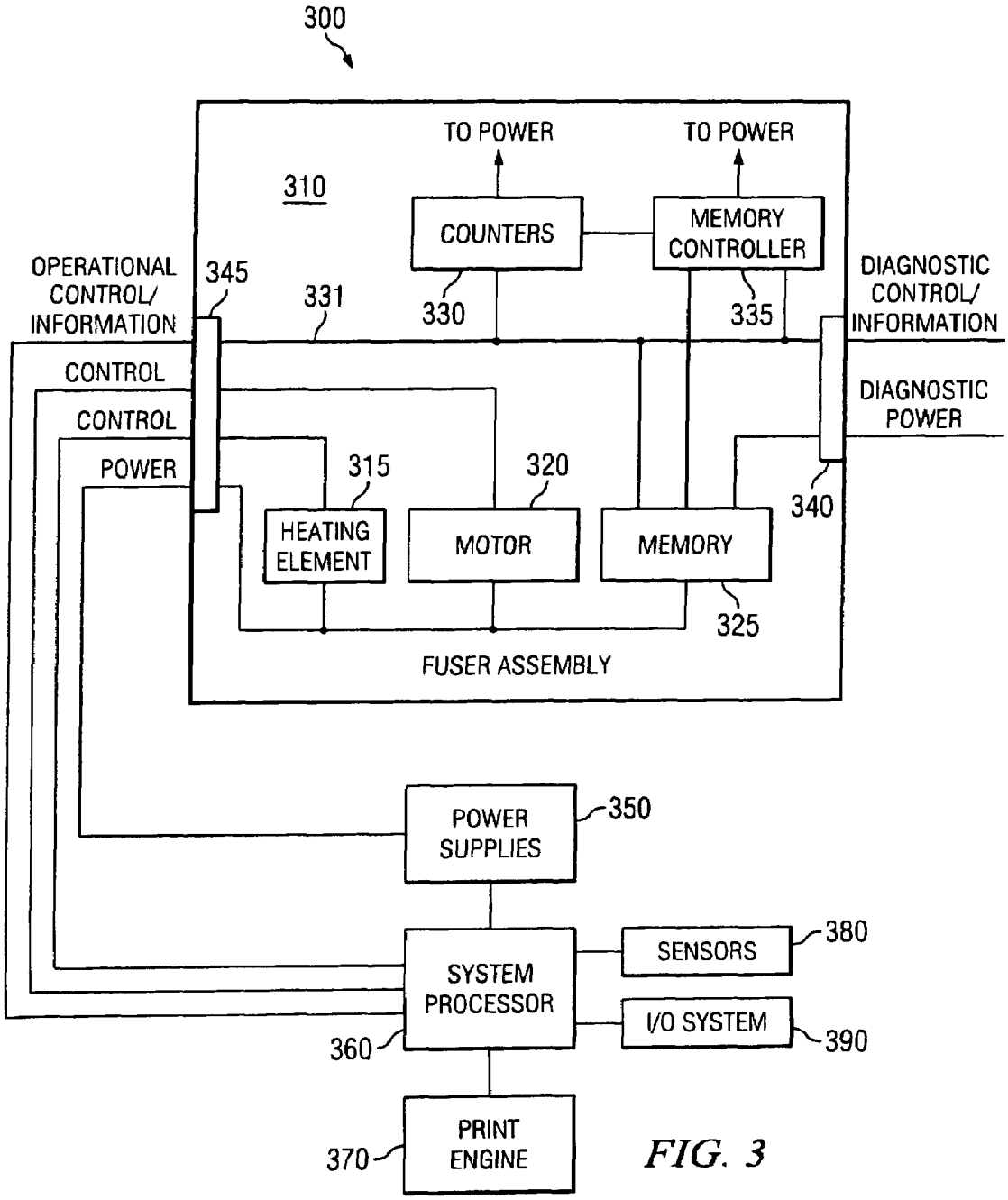
FIG. 3 is a block diagram illustrating a fuser assembly including a memory and the fuser assembly's connections to other subsystems of an image forming system according to an embodiment of the present disclosure.

Referring next to FIG. 3, a block diagram of a system 300 according to an embodiment of the present disclosure will be discussed. System 300 represents a simplified diagram illustrating connections between various portions of an image forming system according to an embodiment of the present disclosure. System 300 may include fuser assembly 310, system processor 360, power supply 350, sensors 380, print engine 370 and input/output system 390. Note that FIG. 3 illustrates primarily electrical and communication connections between various electronic or electrical components, but does not necessarily correspond directly to physical connections of an image processing system. Those physical connections, however, can be constructed according to the teachings set forth herein by one skilled in the art.

Fuser assembly 310 may include a heating element 315, a motor 320, a memory 325, counters 330, and a memory controller 335. Fuser assembly 310 may also include two connectors: diagnostic connecter 340 used to provide input/output for diagnostic control information and power; and main connector 345 used to provide operational control signals, power, and information communication between fuser assembly 310 and system processor 360. The fuser assembly may also, while not required, include a motor 320.

Memory 325 may be used to store any various types of information useful in determining the conditions under which fuser assembly 310 has been operating. Memory 325 may also be used, in at least one embodiment, to hold identification information related to fuser assembly 310 or the image forming system in which fuser assembly 310 is installed.

Memory controller 335 may control storage of information into memory 325, and the reading of information from memory 325. Information within fuser assembly 310 may be carried on communications bus 331, which in one embodiment is an $I^2C$ bus, or another suitable communications bus. In the illustrated embodiment, memory 325 connects to system processor 360 through connector 345, and with diagnostic equipment through connector 340, although other embodiments may use a common connector, or various other connection schemes. In addition, the system may include a wireless system, as know in the art, to transfer information from memory 325.

Considering first the operation of memory 325 during normal operation, consider the case where fuser assembly 310 does not include sensors. Sensors 380 may be placed at various positions throughout image forming system 300 and communicate sensed events to system processor 360. System processor 360 may put event data onto communications bus 331 through connector 345. Bus 331 may provide the event data to counters 330, which in at least one embodiment, may include multiple counters, one counter for each type of information to be stored in memory 325.

Counters 330 may include, for example, one counter for counting the number of pages processed by image forming system 300, and one counter for counting the number for example, of revolutions of motor 320, if a motor 320 is included in the fuser assembly. Sensors 380 may include a narrow media sensor, the counter in counters 330 responsible for counting the number of narrow media processed by fuser assembly 310 may be updated once each time a narrow media sensor indicates that narrow media, e.g. pages, is being processed. Once the counter 330 reaches a predetermined value, it may send a message to memory controller 335 indicating that memory 325 should be updated.

Alternatively, counters 330 may count events from multiple different sensors 380, and then upon a triggering count, for example, a number of rotations of a motor 320 if one is utilized, memory controller 335 may store counts from all the different counters to memory 325. In other embodiments, counters 330 are not employed, and system processor 360 may send information to memory 325 only when memory 325 is required to store that information.

Input/output system 390 may be used to read information from memory 325 in some embodiments. So, for example, if an image forming system includes a user accessible display, input/output system 390 may display a menu that allows a user to view selected contents of memory 325.

In other embodiments, however, the contents of memory 325 may be encoded, and access to its contents may not be provided through an input/output system 390. In some embodiments, fuser assembly 310 may be connected to diagnostic equipment through connector 340. Note that in the illustrated embodiment, power may be provided through connector 340 when fuser assembly 310 is connected to diagnostic equipment. In this way, the contents of memory 325 may be accessed even though fuser assembly 310 is not connected into an image forming system.

In still other embodiments, fuser assembly 310 may be placed into a test image forming system including a special diagnostic connector to be coupled with connector 340, so that the contents of memory 325 may be read and/or altered as needed.

Figure 4:
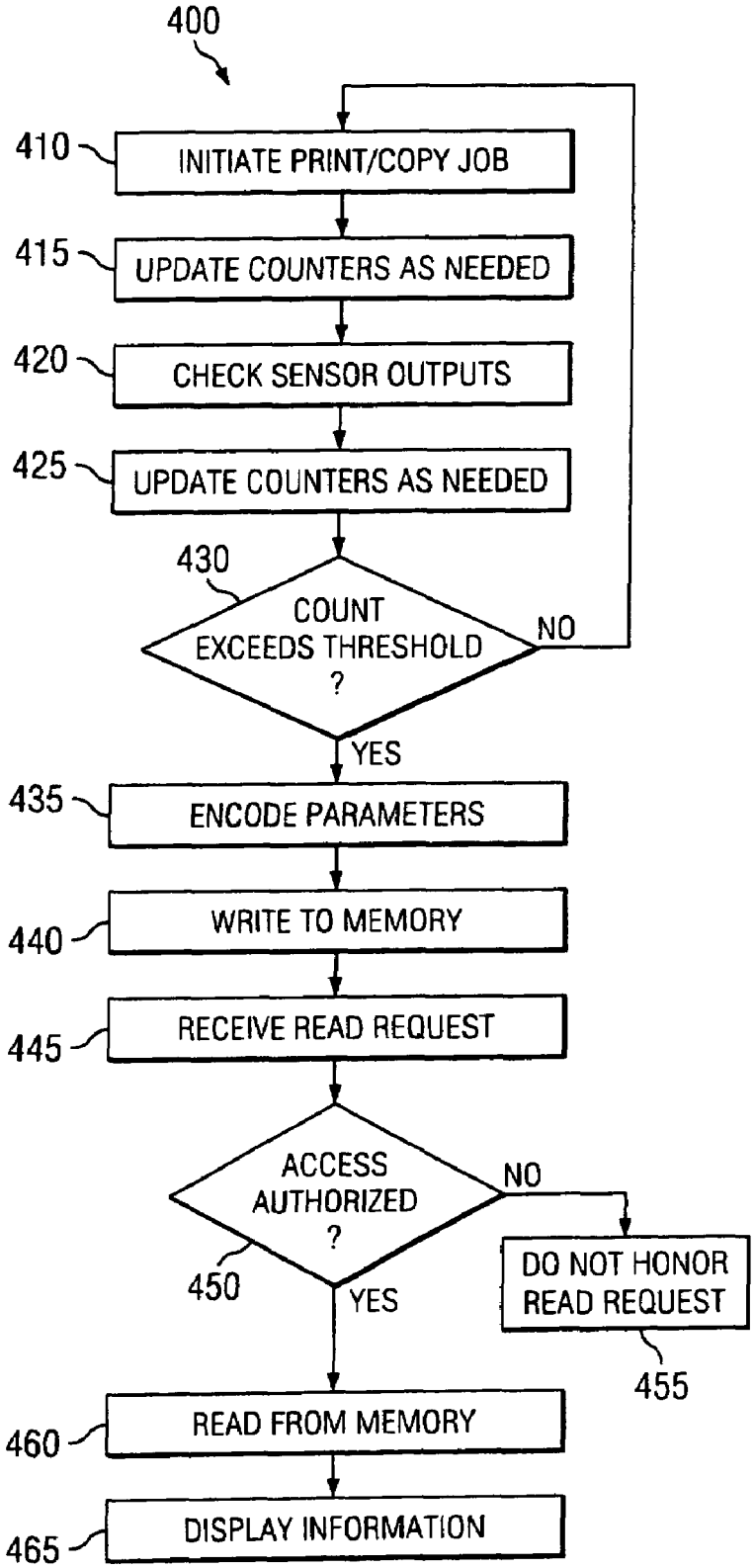
FIG. 4 is a flowchart illustrating a method according to an embodiment of the present disclosure.

Referring next to FIG. 4, a method according to an embodiment of the present disclosure will be discussed. At 410 a print or copy job is initiated. The print or copy job may include parameters such as paper size, print quality, or the like. Information included in the print/copy job parameters may be stored in a counter at 415. These counters may be updated upon completion of the copy job, or at another time as desired. Sensor outputs may be checked at 420, and may be checked before, during or after various portions of the print job to, e.g., ensure the most accurate data possible is obtained. The output of various sensors may be used to update the counters again at 425. At this point, the updated counters should reflect accurate information regarding the conditions under which a fuser has been operated.

The method proceeds to 430, where the counts in the counters may be compared against a threshold value. In embodiments with a single counter, if the counter has not exceeded a threshold value the method returns to 410, and awaits initiation of another print or copy job. In embodiments where multiple counters are employed, any one counter exceeding the threshold may cause the method to proceed to 435. Alternatively, some embodiments may require multiple counters to exceed a threshold value before proceeding to 435. If the count stored in a requisite number of counters exceeds the threshold at 430, the method proceeds to 435, where the information held in the counters may be encoded. Once encoded at 435, the method proceeds to 440, where the encoded parameters may be written to a memory included in the fuser assembly.

The information held in the fuser assembly's memory may be read out at 445 in response to a read request. Upon receipt of the read request, the method proceeds to 450, where it may check for authorization to access the memory. If access to the memory is not authorized, the method may proceeds to 455, and does not honor the read request. If, however, access is authorized at 450, the method may proceed to 460 and permits a read from memory.

The contents read from memory at 460 may be displayed at 465 in any of various formats. For example, the contents of memory 460 may be published, e.g., printed, displayed as a flashing code, displayed audibly, or otherwise.

It should be appreciated that although method 400 illustrates particular actions performed in a specific order, other embodiments of the present disclosure may be implemented using additional or fewer actions, or by performing actions in an order other than that illustrated. So, for example, although method 400 illustrates writing encoded parameters to memory once a count exceeds a particular threshold, parameters may be written to memory in an unencoded format if so desired, or upon the occurrence of events other than counters exceeding threshold values. In one embodiment, a power-off sequence of an image forming system may include writing information to the fuser memory upon power-down.

In other embodiments, the contents of a memory integral to a fuser assembly may be read upon power-up. The contents of the memory may then be placed in a volatile memory accessible to a main system-level processor, and the system-level processor may keep a tally of events that indicate conditions under which the fuser is operated. Then, prior to power-down, the system processor may write the updated information back to the memory. It should be appreciated that various read/write schemes may be implemented according to the teachings set forth herein.

Although the disclosed embodiments have been described in detail, it should be understood that various changes, substitutions and alterations can be made to the embodiments without departing from their scope.

What is claimed is:

1. A fuser assembly for an image forming apparatus, the fuser assembly comprising:

a heating member;

a pressure member cooperating with the heating member to affix an image onto a medium passing through a nip formed therebetween; and a memory on-board the fuser assembly to store information including at least one of a number of each of a plurality of different media types processed by the fuser assembly, standby hours and total cartridges since installation of the fuser assembly in an image forming apparatus.

2. A fuser assembly according to claim 1, further comprising a sensor to monitor operation of the fuser assembly.

3. A fuser assembly according to claim 1, further comprising a communications bus in communication with the memory.

4. A fuser assembly according to claim 3, further comprising an interface configured to be coupled to a print engine.

5. A fuser assembly according to claim 1, further comprising an interface configured to be coupled to diagnostic equipment.

6. A fuser assembly according to claim 1, wherein the memory comprises an electrically erasable programmable read only memory (EEPROM).

7. A fuser assembly according to claim 1, wherein the memory is configured to store one or more types of information selected from the list consisting of:

a number of wide pages processed by the fuser assembly;
a number of pages processed by the fuser assembly;
a number of narrow pages processed by the fuser assembly;
a number of non-envelopes processed by the fuser assembly;
a number of revolutions associated with the fuser assembly;
a number of paper labels processed by the fuser assembly;
a number of vinyl labels processed by the fuser assembly;
a number of envelopes processed by the fuser assembly;
a number of thumps performed by the fuser assembly;
a serial number;
identification information associated with a unit in which the fuser assembly is installed;
fuser assembly history;
number of cardstock processed by the fuser assembly;
number of pages of media and type previously processed by an image forming apparatus prior to the installation of the fuser assembly;
data to be output if the fuser assembly is correctly installed and programmed;
serial numbers of previous image forming apparati into which the fuser assembly has been installed; and
a flag to indicate if fuser assembly is in an operating state and/or disabled;
a date on which the fuser assembly was installed; and
an indication of whether an edge-to-edge mode is enabled.

8. The assembly according to claim 1, wherein the memory further stores information not associated with the fuser assembly.

9. The assembly according to claim 8, further comprising a wireless system for transferring information from the memory.

10. The assembly according to claim 1, further comprising a wireless system for transferring information from the memory.

11. The assembly according to claim 1, wherein said memory comprises a rewritable memory.

12. A fuser assembly according to claim 1, wherein said memory stores at least one of a number of each of a plurality of media types processed by the fuser assembly and total cartridges since installation of the fuser assembly in the image forming apparatus.

13. An image forming system comprising:

at least one sensor to detect paper size;
a print engine to deposit toner on a medium to form an image; and
a fuser assembly to affix the image to the medium, said assembly comprising on-board memory storing information associated with said at least one sensor, wherein said on-board memory further stores information including at least one of a number of each of a plurality of different media types processed by the fuser assembly, standby hours and total cartridges since installation of the fuser assembly in an image forming apparatus.

14. The system of claim 13, further comprising:

a processor; and
a communications bus in communication with the processor and the on-board memory.

15. The system of claim 13, wherein the assembly further comprises an interface configured to be coupled to diagnostic equipment.

16. The system of claim 13, wherein said on-board memory comprises an electrically erasable programmable read only memory (EEPROM).

17. The system of claim 13, wherein the information associated with said memory is configured to store one or more types of information selected from the list consisting of:

a number of wide pages processed by the fuser assembly;
a number of pages processed by the fuser assembly;
a number of narrow pages processed by the fuser assembly;
a number of non-envelopes processed by the fuser assembly;
a number of revolutions associated with the fuser assembly;
a number of paper labels processed by the fuser assembly;
a number of vinyl labels processed by the fuser assembly;
a number of envelopes processed by the fuser assembly;
a number of thumps performed by the fuser assembly;
a serial number;
identification information associated with a unit in which the fuser assembly is installed;
fuser assembly history;
number of cardstock processed by the fuser assembly;
number of pages of media and type previously processed by an image forming apparatus prior to the installation of the fuser assembly;
data to be output if the fuser assembly is correctly installed and programmed;
serial numbers of previous image forming apparati into which the fuser assembly has been installed; and
a flag to indicate if fuser assembly is in an operating state and/or disabled;
a date on which the fuser assembly was installed; and
an indication of whether an edge-to-edge mode is enabled.

18. The system of claim 13, wherein said system comprises a printer.

19. The system of claim 13, wherein said system comprises a copier.

20. The system of claim 13, wherein said sensor senses paper width.

21. A method for use in an image forming system comprising a fuser assembly, the method comprising:

monitoring a parameter associated with the fuser assembly wherein said parameter comprises one of a number of each of a plurality of different media types processed by the fuser assembly, standby hours and total cartridges since installation of the fuser assembly in an image forming system; and
storing the parameter to a memory included in the fuser assembly.

22. The method of claim 21, further comprising:

connecting the fuser assembly to diagnostic equipment; and
reading the one parameter from the memory.

23. The method of claim 21, wherein storing the parameter to the memory comprises writing information to the memory in response to a number of events exceeding a threshold.

24. The method of claim 21, further comprising storing, to the memory, one or more types of information selected from the list consisting of:

a number of wide pages processed by the fuser assembly;
a number of pages processed by the fuser assembly;

a number of narrow pages processed by the fuser assembly;

a number of non-envelopes processed by the fuser assembly;

a number of revolutions associated with the fuser assembly;

a number of paper labels processed by the fuser assembly;

a number of vinyl labels processed by the fuser assembly;

a number of envelopes processed by the fuser assembly;

a number of thumps performed by the fuser assembly;

a serial number;

identification information associated with a unit in which the fuser assembly is installed;

fuser assembly history;

number of cardstock processed by the fuser assembly;

number of pages of media and type previously processed by an image forming apparatus prior to the installation of the fuser assembly;

data to be output if the fuser assembly is correctly installed and programmed;

serial numbers of previous image forming apparati into which the fuser assembly has been installed; and a flag to indicate if fuser assembly is in an operating state and/or disabled;

a date on which the fuser assembly was installed; and an indication of whether an edge-to-edge mode is enabled.

25. The method of claim 21, further comprising storing the parameter in an encoded format.

26. The method of claim 21, further comprising:

reading the parameter from the memory; and providing the parameter in response to selection of an item of a system menu.

* * * * *